US008137016B2

(12) United States Patent
Dobkin et al.

(10) Patent No.: US 8,137,016 B2
(45) Date of Patent: Mar. 20, 2012

(54) TENSIONING PRINT MEDIA

(75) Inventors: Igor Dobkin, Netanya (IL); Yuval Dim, Moshav Haniel (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 463 days.

(21) Appl. No.: 12/422,133

(22) Filed: Apr. 10, 2009

(65) Prior Publication Data

US 2010/0260529 A1 Oct. 14, 2010

(51) Int. Cl.

| | |
|---|---|
| ***B41J 15/00*** | (2006.01) |
| ***B41J 2/01*** | (2006.01) |
| ***D02J 1/22*** | (2006.01) |
| ***B65H 23/08*** | (2006.01) |
| ***B65H 23/00*** | (2006.01) |
| ***B65H 59/00*** | (2006.01) |
| ***B65H 77/00*** | (2006.01) |

(52) U.S. Cl. ..... 400/618; 28/240; 226/195; 242/410; 242/147 R; 347/104

(58) Field of Classification Search ..... 400/618; 28/240; 226/195; 242/410, 147; 347/104
See application file for complete search history.

(56) References Cited

U.S. PATENT DOCUMENTS

| | | | | |
|---|---|---|---|---|
| 5,893,021 | A * | 4/1999 | Yanashima | 399/384 |
| 6,082,914 | A | 7/2000 | Barrus et al. | |
| 6,454,197 | B1 | 9/2002 | Everett | |
| 2007/0059078 | A1 | 3/2007 | Silverbrook et al. | |

FOREIGN PATENT DOCUMENTS

| | | |
|---|---|---|
| JP | 2006137607 | 6/2006 |
| WO | WO2008093157 | 8/2008 |

* cited by examiner

*Primary Examiner* — Michael G Lee
*Assistant Examiner* — Laura Gudorf

(57) ABSTRACT

A method of tensioning multiple webs of print media for a web printer is presented. The method comprises the steps of: feeding each print media web through a print media feeding path of the web printer; and attaching one or more tensioning weights to each print media web so as to impart a tension in each print media web. The total weight value of the one or more tensioning weights attached to each web of print media is substantially the same so that the tension imparted in each print media web is substantially equal.

10 Claims, 6 Drawing Sheets

TENSIONING PRINT MEDIA

BACKGROUND

Printers such as inkjet printers which print onto a variety of print media such as paper or film are well known. As well as accepting print media in a single sheet format, some printers also accept print media fed from a supply roll of print media, in other words a web of print media. Such a printer may be typically referred to as a web printer, being a printer that accepts a web of print media. Paper, vinyl, textiles, fabrics, and others are examples of print media.

Relative movement between the print media and the print head enables print media coverage and image creation. A majority of billboards and banners having relatively large dimensions are printed on flexible print media. Such print media represent rolls or webs of flexible material that are up to five meters wide.

The feeding of a web of print media from a roll for a large format printer is typically undertaken by means of rollers, some of which induce the media movement and others change the media direction or form nips enabling media transportation. In the context of the present disclosure the term "nip" means the gap or width of the gap between two parallel rollers. The nip may have a desired width or the rollers may be in contact having a nip width equal to zero.

The print media is pulled from a roll that has a mechanism to provide tension (back-tension) in the media so as to reduce undulations or wrinkles in the media. In the context of the present application the term "back tension" means the force that keeps the substrate tensioned with respect to a drive roller. A difference in rotational speed between two or more rollers typically generates the back tension. Despite this back tension, undulations or wrinkles are sometimes formed before a nip and close to a location of one of the rollers, usually a tensioning roller. Small undulations are sometimes pulled into the nip between different rollers and reach a printing zone or region of the printer, degrading the quality of printed images. In some cases larger undulations may be pulled into the nip and irreparably damage the print media or even disrupt the printing process. One approach to these issues is to aim to reduce the number and size of the undulations by improving the accuracy of the printer, and/or using highly stable and relatively stiff print media, which complicates transportation and adds to the cost of both the printer and the print media.

International Patent Application Publication Number WO/2008/093157 discloses a method of tensioning and printing on a single wide format media roll comprising: applying a back tension to a web of print media being printed upon at a printing zone; and relaxing the back tension from time to time so as to allow undulations in the web downstream of a printing zone to relax out of the web prior to the web being wound onto a collection roller. This method is adequate when printing is performed on a single roll. However, when more than one roll of print media is simultaneously loaded on the printer, it is difficult to equally tension each of these rolls. The print quality on each web of print media may therefore be different and, in many cases, where the sections of the same billboard are printed on different webs (such as a large billboard) the assembly results in unwanted visible artifacts.

BRIEF DESCRIPTION OF THE DRAWINGS

For a better understanding of the invention, embodiments will now be described, purely by way of example, with reference to the accompanying drawings, in which.

DETAILED DESCRIPTION OF THE INVENTION

Figure 1:
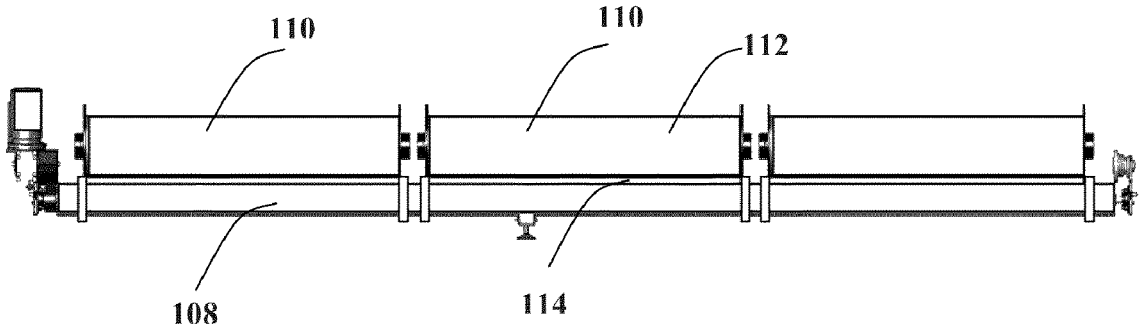
FIG. 1 is a schematic illustration of the front of a wide format printer according to one exemplary embodiment.

FIG. 1 is a schematic illustration of a front view (arrow A, FIG. 2) of a print media loading section with a multiple, rolls 110 of print media 112 and a support roller 108. The nip 114 (in other words, the gap or width of the gap) between the rolls 110 of print media 112 and the support roller 108 may have different values along the longitudinal length of the support roller 108. There may also be differences between the print media 112 wound on different rolls 110. Accordingly, it may be difficult to ensure uniform tension across all of the print media 112 to be used.

According to an embodiment of the invention, there is provided a method of tensioning multiple webs of print media, said method comprising: feeding each web of print media through a print media feeding path, and attaching one or more weights to the each web of print media so as to impart a tension in each web of print media, wherein the total weight attached to each web of print media is of substantially the same value.

Figure 2:
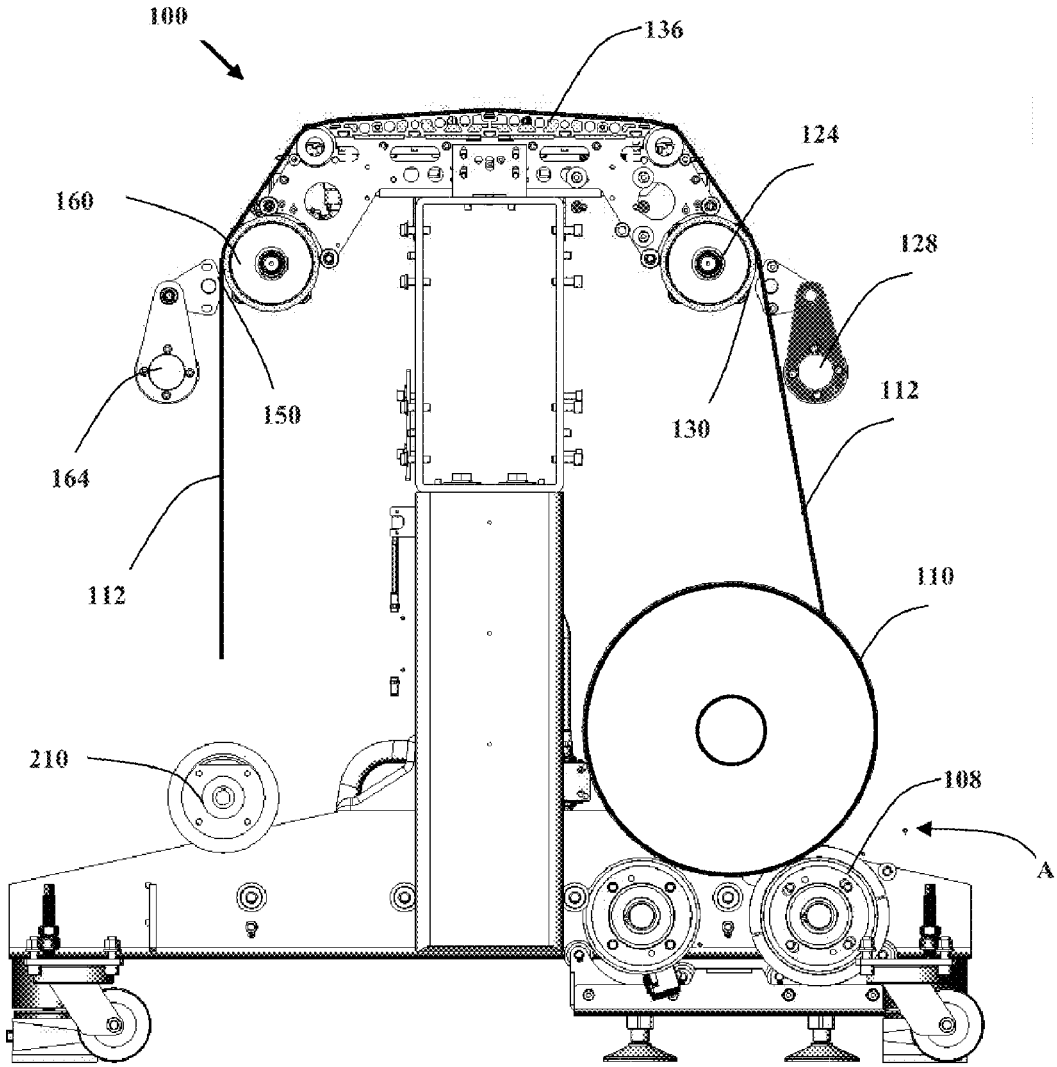
FIGS. 2 to 4 are schematic cross sections of the wide format printer of FIG. 1 illustrating a method of printing according to an embodiment.

FIG. 2 is a schematic cross section of a wide format printer 100. Spaced apart from back tension roll 124 is a drive roll 160 and associated with these are first 128 and second 164 pressure rolls, respectively. The back tension roll 124 and associated first pressure roll 128 span at least the width of the print media on which printing is to be performed. Similarly, the drive roll 160 and associated second pressure roll 164 span at least the width of the print media on which printing is to be performed.

The distance between the surfaces of the back tension roll 124 and its associated first pressure roll 128, which are generally parallel to each other, form a back tension nip 130. Also, the distance between the surfaces of the drive roll 160 and its associated second pressure roll 164, which are generally parallel to each other, form a drive nip 150.

The first 128 and second 164 pressure rolls are each mounted on a pivotally-mounted clamping bracket 130. Each clamping bracket 130 can be pivoted between first (open) and second (closed) positions. When in the first (open) position, the associated pressure roll of the clamping bracket is distanced from the back tension roll 124 or drive roll 160 so that the pressure roll does not contact the print media 112 and the nip is fully/widely open. When in the second (closed) position, the associated pressure roll of the clamping bracket is narrowly spaced apart from the back tension roll 124 or drive roll 160 so that the pressure roll contacts and bends the print media 112 and the nip is closed (i.e. the nip value is close to zero). Thus, it will be understood that variation of the clamping brackets 130 between the first and second positions varies the distance between the pressure rolls and the associated back tension 124 and drive 160 roll and changes the width of nips 130 and 150.

Pistons (not shown) are arranged to move the clamping brackets between the first (open) and second (closed) positions. Here the pistons are hydraulic or pneumatic pistons, but they could be electromechanical or other powered movement—causing devices, such as pistons.

Also shown in FIG. 2 there is provided a support surface 136 which is a curved unitary surface, or is assembled from separate segments, and over which printing takes place. This may be referred to as the printing area. Support surface 136 is located in the space between the back tension roll 124 and the drive roll 160.

A web of print media 112 is threaded in the print media feed path from a supply roll 110 that stores print media, through the back tension nip 130 formed by back tension roll 124 and the associated first pressure roll 128, over support surface 136 where printing takes place, over and past drive roll 160 and its associated second pressure roll 164, and through the drive nip 150 formed by them. Generally, printed media 112 may be collected on a print media collection roll 210, or collected as a free-fall print media web. The free fall method may be used to satisfy a "print-on-demand" requirement. It may be simpler than to collect the prints on a roll and later cut the web.

Thus, it will be understood that with the print media being fed from the supply roll 110 past the printing area and past/through the drive nip 150, the drive roll 160 is downstream of the printing area, whereas the back tension roll 124 is upstream of the printing area.

Figure 3:
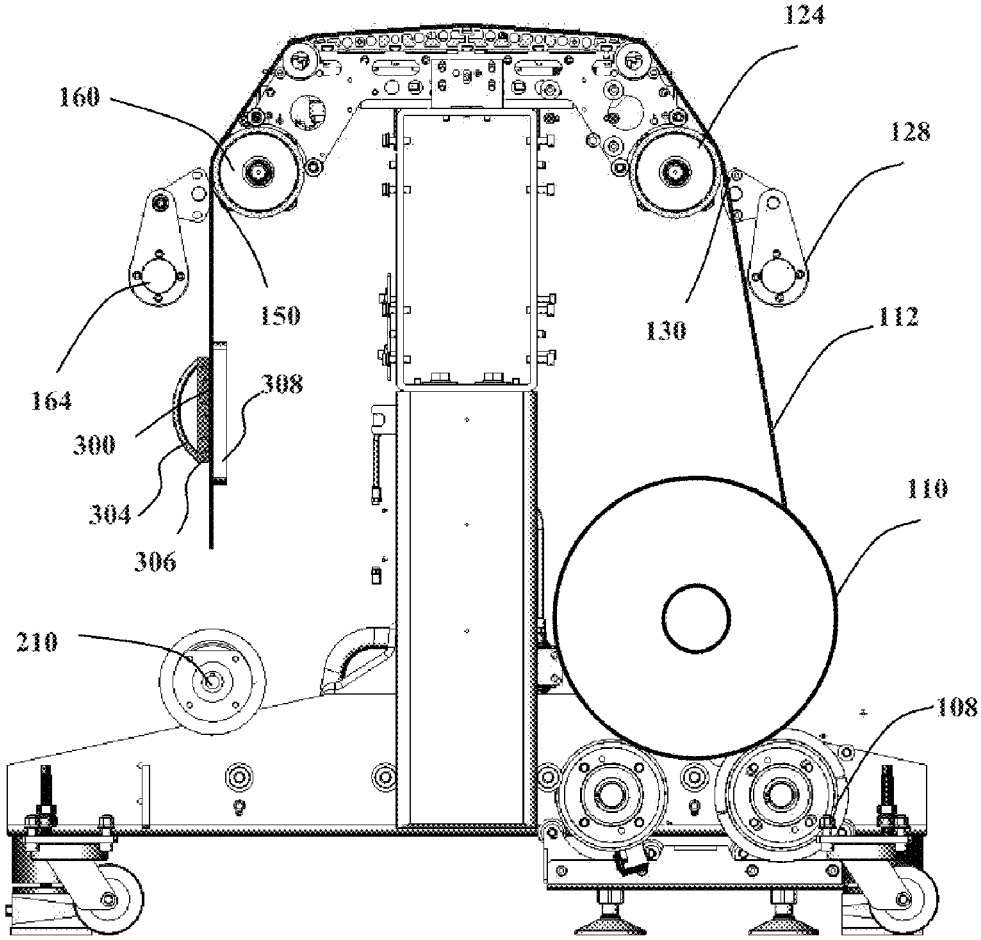
Figure 4:
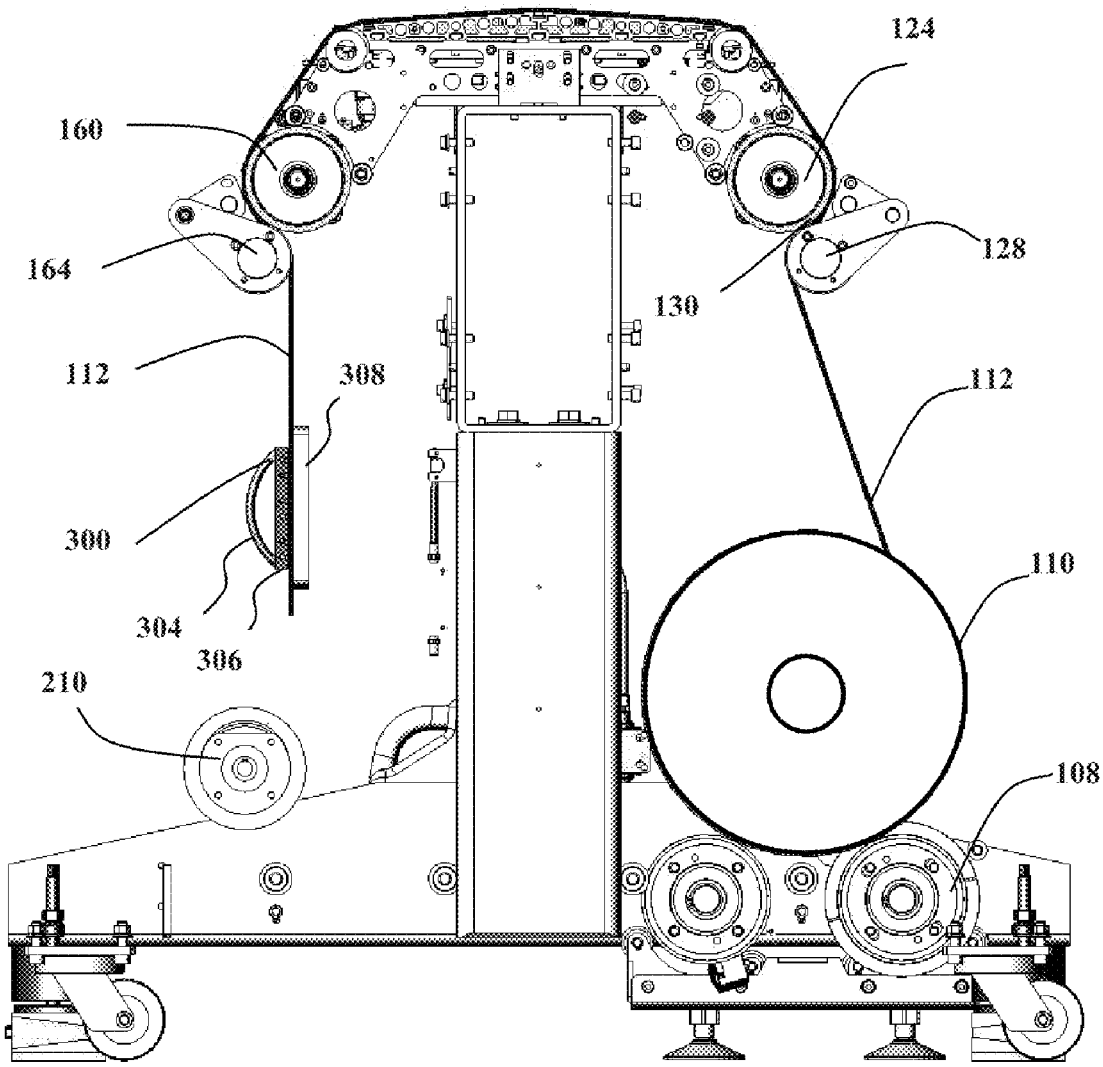

Referring to FIGS. 2 through 4 an embodiment will now be described. In order to ensure a uniform and equal tension to all web print media 112, each web of print media 112 is threaded into nips 130 and 150 between the back tension 124 and drive 160 roll and first 128 and second 164 pressure rollers. As shown in FIG. 2, to facilitate print media 112 threading, the nips 130 and 150 are widely open by moving the pivotally-mounted clamping brackets 130 to their first (open) position, thereby distancing the rolls 124 and 160 from the associated pressure rollers 128 and 164. Following the threading, the web of print media 112 is left in a free falling condition and not wound on print media collecting roll 210. Thus, tension in the print media web is relieved or relaxed by distancing the rolls 124 and 160 from the associated pressure rollers 128 and 164.

Next, equal weights 300, in the range of 1 kg to 3 kg for example, are attached to the free falling portion of each web of print media 112 as shown in FIG. 3. Under the force of gravity, the weights 300 exert equal tension to each web of print media 112. Following tensioning of the webs of print media 112 the nips 130 and 150 are closed by moving the pivotally-mounted clamping brackets 130 to their second (position) position as shown in FIG. 4. Depending on desired printing mode, the webs of print media may be left in a freefall state or connected to the print media 112 collecting roll 210, and a printing process may then begin. In FIG. 4, the webs of print media are left in a freefall state for "print-on-demand" operation.

Figure 5:
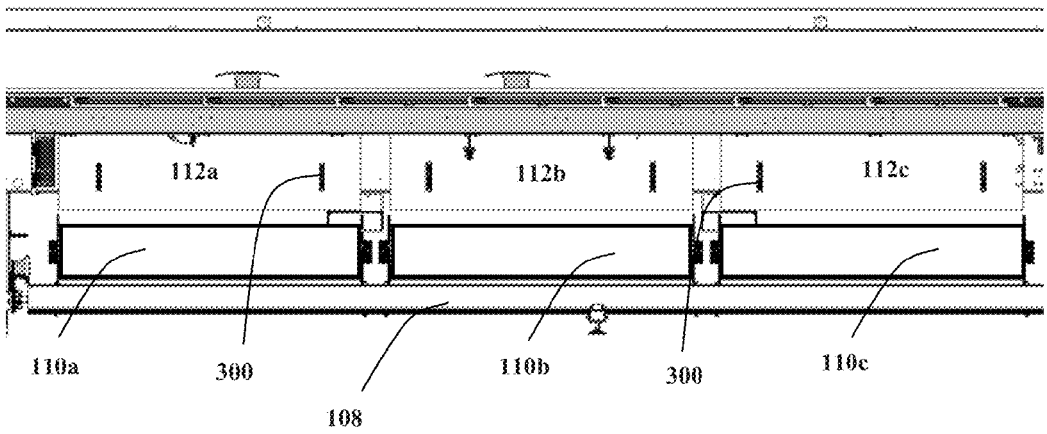
FIG. 5 is a schematic illustration of the front of a wide format printer illustrating a method of tensioning print media according to an embodiment.

FIG. 5 is front of the printer of FIG. 3 illustrating a method of tensioning print media according to an embodiment. First 110*a* to third 110*c* rolls of print media provide first 112*a* to third 112*c* webs of print media through the feed path, respectively. A tensioning weight 300 of 1 kg is releasably attached to the free falling portion of each print media webs 112*a*, 112*b* and 112*c* so as to the same tension in each web. Thus, by attaching a 1 kg weight to each print media web prior to closing the nips 130 and 150, wherein the weight is the same for each print media web, a uniform tension across all of the print media 112 can be arranged.

Figure 6:
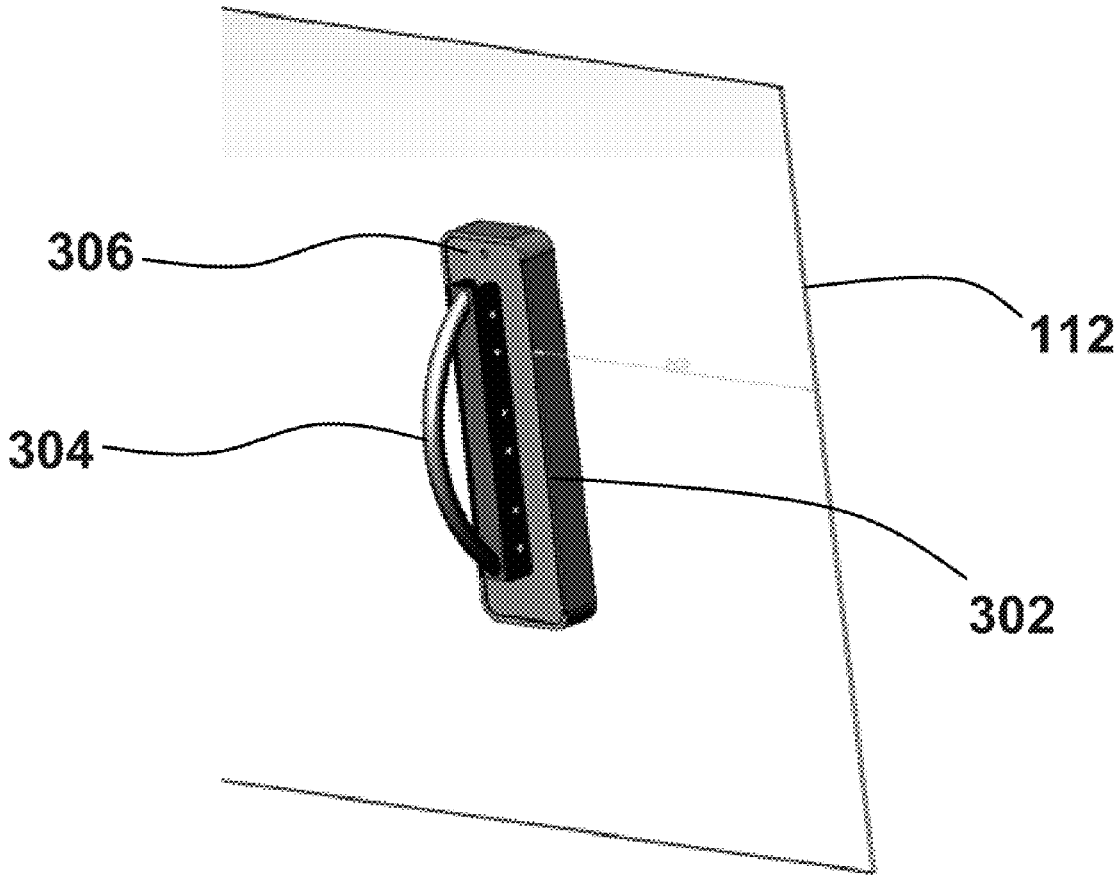
FIG. 6 is an illustration of a tensioning weights used in a method according to an embodiment.

FIG. 6 is an illustration of a tensioning weight 300 that may be used in a method according to an embodiment. The tensioning weight 300 comprises a magnetic arrangement of two main components which are adapted to be magnetically attracted to each other. The first main component 302 comprises a handle 304 attached to a substantially flat surface 306, and the second main component 308 (not visible in FIG. 6, but shown in FIGS. 3 and 4) comprises a substantially flat surface. The flat surface 306 of the first main component 302 is positioned adjacent the flat surface of the second main component with the print media sandwiched therebetween. The first main component 302 and the second main component 308 are thus held together by a magnetic force so that they attach to the print media and the print media 112 hangs freely with the weight imparting a tension in the print media.

By attaching the same tensioning weight 300 to each of a plurality of print media webs, the print media webs can be arranged to have the same tension before a printing process is undertaken. Upon completion of the print media 112 tensioning process, the weights 300 are removed from the print media 112. A printing process using the print media can then takes place with the print media hanging freely (as shown in FIG. 4) or being connected to the print media 112 collecting roll 210.

Embodiments provide a method of tensioning multiple webs of print media. Each web of print media may be arranged to have a portion which hangs freely from the printer. One or more weights may then be releasably attached to each web of print media so as to tension the print media. By attaching one or more weights having the same total weight value for each print media web, the value of tension created in each print media web is substantially the same, therefore ensuring uniform tension across the multiple webs of print media.

Multiple tensioning weights 300 may be used to tension multiple webs simultaneously. The total weight value of the one or more tensioning weights attached to each web of print media may be substantially the same so that the tension imparted in each print media web is substantially equal.

Alternatively, the same tensioning weight may be used to tension multiple webs consecutively, thereby ensuring the same tension is created in each web using and only requiring a single tensioning weight.

It will be appreciated that embodiments may be used to ensure that the tension of multiple print media webs for a wide format printer is substantially uniform, therefore helping to reduce the difference in print quality between multiple print media webs of the same printer. Thus, embodiment may improve print quality and enable improved printer utilization.

While specific embodiments have been described herein for purposes of illustration, various modifications will be apparent to a person skilled in the art and may be made without departing from the scope of the invention.

We claim:

1. A method of tensioning multiple webs of print media for a web printer, wherein the method comprises the steps of:

feeding each print media web through a print media feeding path of the web printer;

attaching one or more tensioning weights to each print media web so as to impart a tension in each print media web, wherein the total weight value of the one or more tensioning weights attached to each web of print media is substantially the same so that the tension imparted in each print media web is substantially equal.

2. A method according to claim 1, further comprising the steps of:

prior to attaching the one or more tensioning weights to each print media web, relieving or relaxing tension in the print media web by arranging a pressure roller to be distanced from the print media web; and after attaching one or more tensioning weights to each print media web, maintaining the tension in the print media web by arranging the pressure roller to contact the print media web.

3. A method according to claim 1, wherein the step of attaching one or more tensioning weights to each print media is undertaken using equal tensioning weights so that the multiple webs of print media are tensioned by the same force at the same time.

4. A method according to claim 1, wherein the step of attaching one or more tensioning weights to each print media web is undertaken using a single tensioning weight by consecutively attaching then detaching the tensioning weight to different print media webs.

5. A method according to claim 1, wherein a tensioning weight comprises an arrangement of first and second parts which are adapted to be magnetically attracted to each other.

6. A method according to claim 4, wherein the step of attaching a tensioning weight to each print media web comprises:

arranging a first part of a magnetic arrangement adjacent a second part with the print media sandwiched therebetween.

7. A method according to claim 1, wherein the web printer is a large format printer.

8. A method according to claim 1, wherein the printer comprises:

a printing zone adapted to print, in use, upon the webs of print media; and one or more rollers adapted to displace the print media webs past the printing zone, and wherein the step of attaching one or more tensioning weights to each print media web comprises attaching the one or more tensioning weights to each print media web downstream of the printing zone.

9. A method of printing on multiple webs of print media with a web printer, comprising tensioning the multiple webs according to the method of claim 1.

10. A device adapted to tension a print media web for a web printer comprising:

a tensioning weight adapted to be releasably attached to the print media web, and first and second parts adapted to sandwich the print media web therebetween when attached to the print media web, wherein the first and second parts are adapted to be magnetically attracted to each other.

* * * * *